US005138848A

United States Patent [19]

Schnurrer et al.

[11] Patent Number: 5,138,848

[45] Date of Patent: Aug. 18, 1992

[54] NON-ROTATABLE REMOVABLY MOUNTED CAM SECTIONS

[75] Inventors: Hans Schnurrer; Ernst-Dieter Plath, both of Albstadt, Fed. Rep. of Germany

[73] Assignee: SIPRA-Patententwicklungs-und Beteiligungsqesellschaft mbh, Albstadt, Fed. Rep. of Germany

[21] Appl. No.: 606,714

[22] Filed: Oct. 31, 1990

[30] Foreign Application Priority Data

Nov. 10, 1989 [DE] Fed. Rep. of Germany ..... 3937390

[51] Int. Cl.[5] ..... D04B 15/32

[52] U.S. Cl. ..... 66/57; 66/78

[58] Field of Search ..... 66/57, 78

[56] References Cited

U.S. PATENT DOCUMENTS

| | | | |
|---|---|---|---|
| 350,794 | 10/1886 | Wilcomb . | |
| 3,670,526 | 6/1972 | Martinetz | 66/57 X |
| 3,800,561 | 4/1974 | Beuter et al. | 66/57 |
| 4,037,434 | 7/1977 | Durville et al. | 66/57 |

FOREIGN PATENT DOCUMENTS

| | | | |
|---|---|---|---|
| 0314062 | 5/1989 | European Pat. Off. . | |
| 0348896 | 1/1990 | European Pat. Off. | 66/57 |
| 1585412 | 11/1970 | Fed. Rep. of Germany . | |
| 2053856 | 7/1971 | Fed. Rep. of Germany . | |
| 2366173 | 11/1973 | Fed. Rep. of Germany . | |
| 2242169 | 4/1974 | Fed. Rep. of Germany . | |
| 2544197 | 4/1977 | Fed. Rep. of Germany . | |
| 2807206 | 8/1978 | Fed. Rep. of Germany . | |
| 2746725 | 4/1979 | Fed. Rep. of Germany . | |
| 7910547 | 8/1979 | Fed. Rep. of Germany . | |
| 7910610 | 9/1979 | Fed. Rep. of Germany . | |
| 8028544 | 2/1981 | Fed. Rep. of Germany . | |
| 3002540 | 7/1981 | Fed. Rep. of Germany . | |
| 3104298 | 12/1981 | Fed. Rep. of Germany . | |
| 3733811 | 4/1989 | Fed. Rep. of Germany | 66/57 |
| 0132597 | 10/1978 | German Democratic Rep. X | 66/57 |

*Primary Examiner*—Werner H. Schroeder
*Assistant Examiner*—John J. Calvert
*Attorney, Agent, or Firm*—Michael J. Striker

[57] ABSTRACT

A knitting machine has at least one bed with a plurality of lands forming tricks for supporting knitting implements, and a cam arrangement for controlling the knitting implements and including a cam plate, at least one carrier mounted to the cam plate at a fixed spacing from the bed, at least one cam portion and a mounting element for non-rotatably mounting the cam portion to the carrier. The mounting element is disposed on the carrier and consists of a sliding guide for loosely and displaceably mounting to cam portion to the carrier with a sliding fit and without the use of fixing element. The sliding guide is formed and extends toward the bed in such a way in a dismantled condition of the carrier a fitting or a removal of the cam portion from a front of the carrier is permitted and that in a mounted condition of the carrier sliding movements of the cam portion toward the bed are possible, which sliding movements are restricted on one side by the carrier and on the other side by the lands of the bed or by the knitting implement, whereas in all directions normal to the sliding movements the cam portion is fixedly positioned by the sliding guide.

30 Claims, 7 Drawing Sheets

FIG. 3A
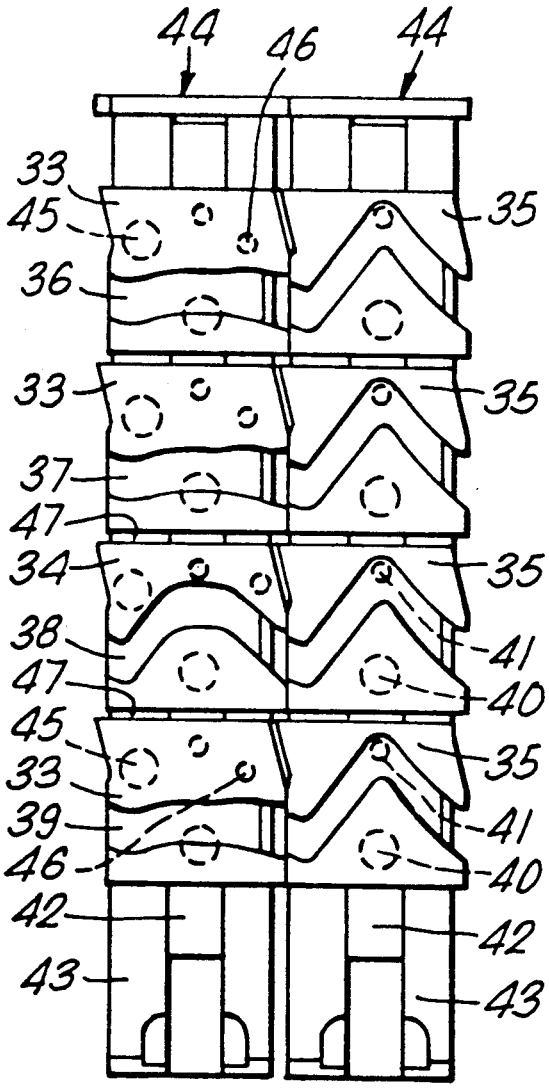
FIG. 3B FIG. 3D
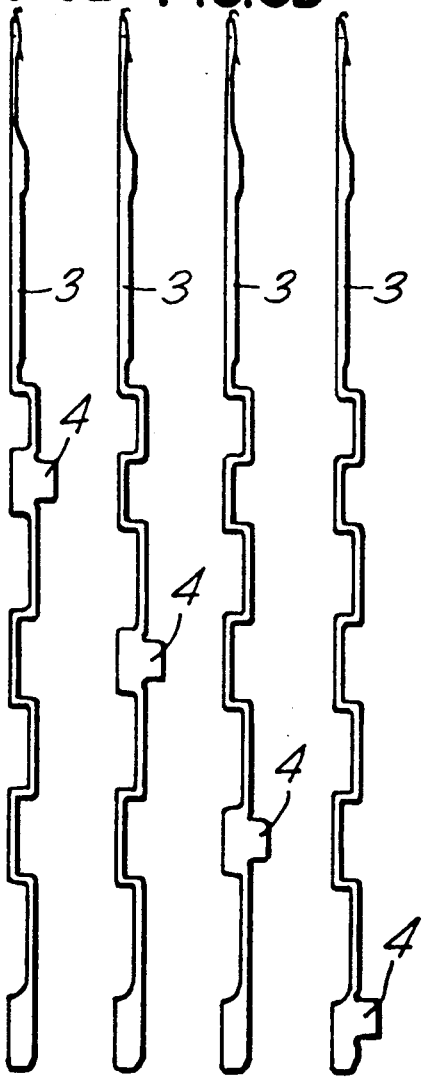
FIG. 3C FIG. 3E

NON-ROTATABLE REMOVABLY MOUNTED CAM SECTIONS

BACKGROUND OF THE INVENTION

The invention relates to a knitting machine. The present invention relates generally to a knitting machine having a bed for knitting implements and a cam arrangement for controlling the knitting implements.

Knitting machines can be provided essentially with three kinds of cam portions.

The cam portions of a first kind are those which are permanently or easily interchangeably mounted to their carriers. Those cam portions are generally mounted on the front side of the carrier which faces the bed for the knitting implements and have either a closed cam track in the form of a groove which is milled into the front side thereof or define a cam track formed from a plurality of cam portions, with the outside contour of the cam portions. Hybrid forms thereof are also known. In such arrangements the holding means comprise fixing means and primarily screwthreaded bores provided in the front side of the carrier and having the axes which extend in the direction of the bed. The bores receive fixing screws which pass through the cam portions. In that way the cam portions are rigidly fixed to the carrier and after fitting thereof are held at a predetermined spacing from the bed, that spacing being referred to as the cam play. Besides those fixing means, such an arrangement generally has additional positioning elements disposed on the carriers and cam portions and formed as pins, bores or the like which fix the position of the cam portions in all directions extending perpendicularly to the axis or operative direction of the fixing means (for example U.S. Pat. No. 4,037,434, German patent specifications Nos. 25 44 197 and 27 46 725, German laid-open application (DE-OS) No. 28 07 206 and German utility model No. 80 28 544). Suitable fixing screws are used when the arrangement has cam portions of a parallelepipedic or cubic configuration a plurality of cam tracks and can be secured to the carriers in different positions (German patent specification No. 23 66 173 and German published specification (DE-AS) No. 22 42 169). It is also known that a plurality of cam portions may be secured to a carrier by means of a single fixing screw (EU 0 314 062) in order to speed up the replacement operation. Instead of using fixing screws, the cam portions may also finally be secured to the carriers by means of elements which have a positive engagement effect and which serve for faster replacement (German patent specification No. 1 938 891), or by glueing, pressing, soldering, brazing or the like (German utility models Nos. 79 10 547 and 79 10 610).

The cam portions of the second kind are mounted on parts of the carrier which are displaceable parallel to the bed of the knitting implements, in order for example to permit adjustment of the stitch length or to perform other functions related to the knitting procedure. In that situation the cam portions are also secured to the movable part of the carrier by fixing means (U.S. Pat. No. 350,794, German laid-open application (DE-OS) No. 22 45 416 and German patent specifications Nos. 30 02 540 and 31 04 298) and are possibly fixed in position by additional positioning elements. In that arrangement the cam play is generally kept constant by the movable part disposed in a positive-engagement guide which extends parallel to the bed.

The cam portions of the third kind which however are of no interest from the point of view of the purposes of the present invention, are fixed to a part of the carrier which is displaceable in the direction of the bed for the knitting implements, in order to permit faster replacement of the cam portions or to control the action of the cam portions on the knitting implements by moving the cam portions forwards and backwards (German published specifications (DE-AS) Nos. 15 85 412 and 20 53 856 and DE-OS No. 25 56 374). In that arrangement fixing of the cam portions to the movable parts of the carrier is indispensible as otherwise it would not be possible to provide the intended function. In addition the forward movement in the bed direction is generally additionally limited by abutments which have a positive engagement action, or the like.

Since the beginning of the knitting machine art, the cam portions of the first and second kinds which are of interest and the cam portions of the third kind, have been fixedly and immovably secured by fixing screws or other fixing means to the carriers which in turn are rigidly or movably mounted to the knitting machine. That fixing action is provided in spite of the generally known fact that, in relation to manufacture, fitment and possibly replacement of the cam portions of the first and second kinds, that fixing effect involves a considerable contribution to the production and assembly costs. In the case of high-system circular knitting machines and when using very small cam portions, there is very little space available for arranging the fixing screws and positioning elements and the above-mentioned means for speeding up the fitting or replacement operation (German patent specification No. 19 38 891, DE-OS No. 37 33 811 and EU 0 314 062) cannot always be used, for various reasons, in part involve even higher production costs, or give rise to problems in regard to the tolerances to be maintained.

SUMMARY OF THE INVENTION

Accordingly, it is an object of the present invention to provide a knitting machines having a cam portion and provided with a simpler holding means which is more advantageous in terms of cost, which saves on time, space and which is suitable both for permanently and for replaceably fitting the cam portions to the carriers thereof, and which renders redundant the use of the fixing means employed hitherto.

In keeping with these objects and with others which will become apparent hereinafter, one feature of the present invention resides, briefly stated, in a knitting machine, comprising at least one bed having a plurality of lands forming tricks for supporting knitting implements; and a cam arrangement for controlling the knitting implements and including a cam plate, at least one carrier mounted to said cam plate at a fixed spacing from said bed, at least one cam portion and mounting means for non-rotatably mounting said cam portion to said carrier, said mounting means being disposed on said carrier and consisting of sliding guide means for loosely and displaceably mounting said cam portion to said carrier with a sliding fit and without the use of fixing means, said sliding guide means being formed and extending toward said bed in such a way that in a dismantled condition of said carrier a fitting or a removal of said cam portion from a front of said carrier is permitted and that in a mounted condition of the carrier sliding movements of said cam portion toward said bed are possible, which sliding movements are restricted on one side by said carrier and on the other side by said lands of said bed or by the knitting implements, whereas in all directions normal to said sliding movements said cam portion is fixedly positioned by said sliding guide means.

The invention provides the surprising advantage that fixing of the cam portions in the direction of the bed which accommodates the knitting implements is not necessary when the cam portions are guided between the bed and an abutment of the carrier with a sliding or push fit. In that connection the sliding guide ensures that the cam portions can be moved only in the direction of the needle bed but not transversely with respect thereto. Occasional knocking of the cam portions against the lands of the bed or the knitting implements involves no risk and does not involve a substantial increase in friction. The cam portions can be easily prevented from falling out of the carriers in the course of fitment or dismantling thereof by virtue of the fact that the sliding guides are sufficiently long and in particular are substantially longer than the usual cam play, or by the use of pins or the like which are provided with clamping springs in the manner of banana pins or plugs. That makes it possible for the first time for the cam portions to be fitted to the carrier without any fixing means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The invention is described in greater detail hereinafter by means of embodiments with reference to the accompanying drawings in which.

DESCRIPTION OF PREFERRED EMBODIMENTS

Figure 1:
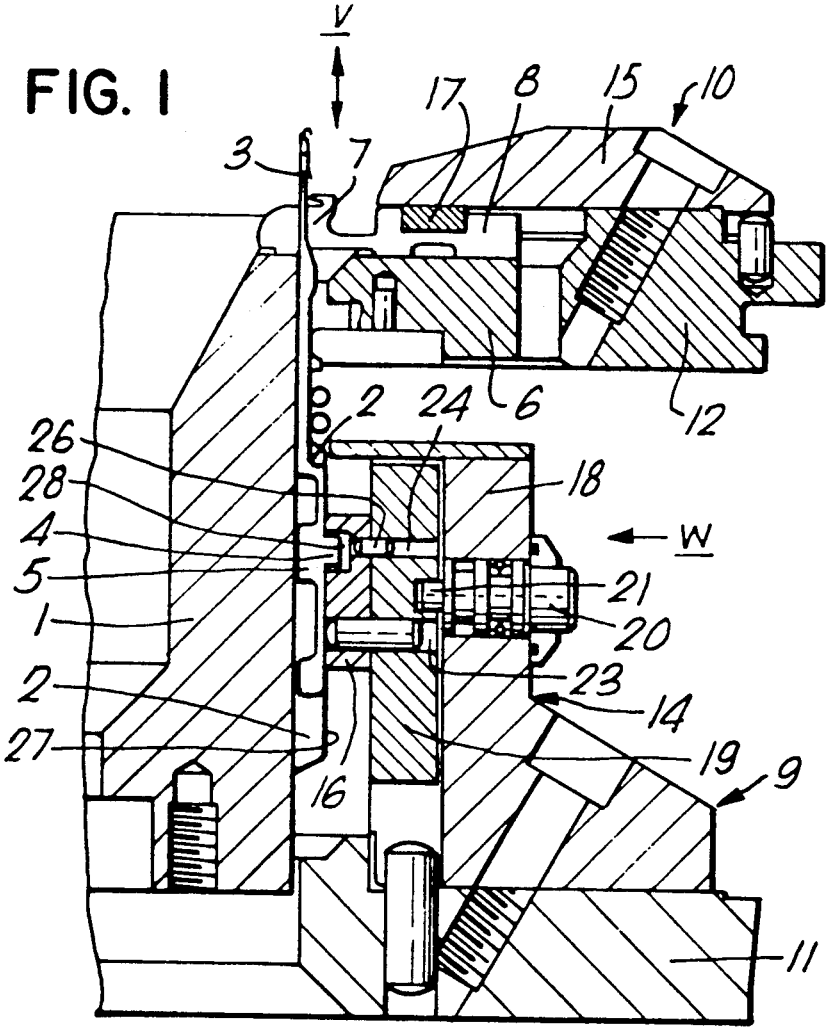
FIG. 1 is a view in radial section through part of a circular knitting machine with a cam arrangement according to the invention.

FIG. 1 shows the details of a circular knitting machine, which are necessary for understanding the invention, namely a first bed 1 in the form of a needle cylinder with vertically extending walls, bars, guiding webs or lands 2 which form tricks in which knitting implements 3, in this case knitting needles, with butts 4 and shanks 5, are slidably mounted. Arranged above the first bed 1 is a second bed 6 in the form of a sinker ring having radially extending lands between which further knitting implements 7, in this case sinkers, with butts 8, are slidably mounted. The knitting implements 3, 7 are controlled by cam arrangements 9 and 10 which each have a respective cam plate 11 and 12, at least one carrier 14, 15 secured thereto, and at least one cam portion 16, 17 which is mounted on the associated carrier and which acts on the butts 4 and 8 of the knitting implements 3 and 7 in known manner. In that situation the beds 1, 6 and cam arrangements 9, 10 are moved relative to each other in a direction which extends normal to the longitudinal direction of the knitting implements 3, 7 and parallel to the respective beds 1 and 6, that is to say normal to the arrows v and w, while at the same time the knitting implements 3, 7, depending on the respective cam portions used, can be extended or pulled down parallel to their longitudinal direction or can be held in the non-knitting or welt position respectively.

The carrier 14 of the cam arrangement 9 includes a part 18 which is stationarily mounted to the cam plate 11 and a part 19 which is mounted movably and which carries the cam portion 16, in the form of a conventional slider which is adjustable parallel to the longitudinal direction of the knitting implements 3 and which serves for adjustment of the sinker depth or stitch or loop length. Provided for that adjustment operation is an adjusting pin 20 which passes through the fixed part 18 and which projects with an eccentric lug 21 into the movable part 19.

Circular knitting machines of that kind and the cam arrangements thereof are generally known to the man skilled in the art and therefore do not need to be described in greater detail herein.

In accordance with the invention the cam portion 16 is mounted to the carrier 14 or the movable part 19 exclusively by means of a sliding guide, that is to say without the use of a fixing means in the form of a fixing screw or the like. In the illustrated embodiment the sliding guide comprises two cylindrical guide openings 23 and 24 which are provided in the part 19, with their axes arranged parallel to the arrow w and being intended to receive respective pins or pegs 25, 26 which project outwardly from the back of the cam portion 16. In that arrangement the pins or pegs 25, 26 are inserted for example into suitable bores at the rear side of the cam portion 16 and are fixedly connected thereto by being a press fit therein, adhesive or in some other fashion, or are made in one piece with the cam portion 16. In that arrangement the bores in the cam portion may be through bores or blind bores.

The pins or pegs 25, 26 are of a cross-section which corresponds to the cross-sections of the guide openings 23 and 24 in such a way that they are arranged with a sliding fit therein, that is to say loosely, and can therefore be reciprocated in the direction indicated by the arrow w. In that connection the fit between the guide openings 23, 24 and the pins or pegs 25, 26 is such that the latter are mounted substantially without play in all directions normal to the arrow w. In that way the guide openings 23, 24 and pins or pegs 25, 26 act at the same time as positioning elements which fix the position of the cam portion 16 in the fitted condition in all directions normal to the arrow w, with the tolerances which are required in knitting machine design, so that no additional positioning elements are required.

In contrast, even in operation of the circular knitting machine, the cam portion 16 is mounted slidably in the direction of the bed 1 (arrow w). Possible sliding movements of the cam portion 16 are restricted on the rear side thereof by it abutting against the part 19 or the carrier 14 and on the front side thereof by the free end faces 27 of the lands 2 if the height of the lands 2 is greater than the height of the shanks 5 of the knitting implements 3. Alternatively it is also possible for the height of the shanks 5 to be somewhat greater than the height of the lands 2. In that case the possible sliding movement of the cam portion 16 is restricted on the front side thereof by the shanks of the knitting implements 3.

The length of the sliding guide for the cam portion 16 in the direction indicated by the arrow w is at least so great that the cam portion 16 is guided with a sliding fit in the range of the cam play which is generally up to about 0.25 mm, wherein the cam play corresponds to the spacing between the end faces 27 of the lands 2 or shanks 5 and the front side of the cam portion 16, which faces towards the lands or shanks, when the cam portion 16 bears with its rear side against the portion 19. Therefore the positioning of the cam portion 16 which is preselected perpendicularly to the arrow w cannot alter even if it is to be reciprocated with a sliding movement in the course of continuous operation of the machine. In actual fact, in a practical situation, the sliding guide is substantially longer, preferably about 3 to 6 mm long, so that the cam portions 16 do not accidentally drop out upon assembly or disassembly of the carriers 14.

In regard to control of the butts 5 by means of a cam track 28 in the front side of the cam portion 16, the loose mounting of the cam portion 16 is also non-critical because the height of the butts 4 and the depth of the cam track 28 can easily be so selected that the butts 4 engage into the cam track 28 in all possible positions of the cam portion 16.

As FIG. 1 further shows, the guide openings 23 and 24 are of different diameters and the pins or pegs 25, 26 are of correspondingly different diameters. In that way, when the carrier 14 is dismantled, the cam portion 16 can only be fitted with one possible positioning thereof on to the portion 19 so that there cannot be any mix-up in that respect. In addition the pins or pegs 25, 26 may be of different lengths so that it is possible for one of the pins or pegs, in this case the pin or peg 26, also to be arranged directly on the rear side of the cam track 28 so that there are no space problems in regard to the provision of the pins or pegs, even when dealing with very small cam portions.

Figure 2:
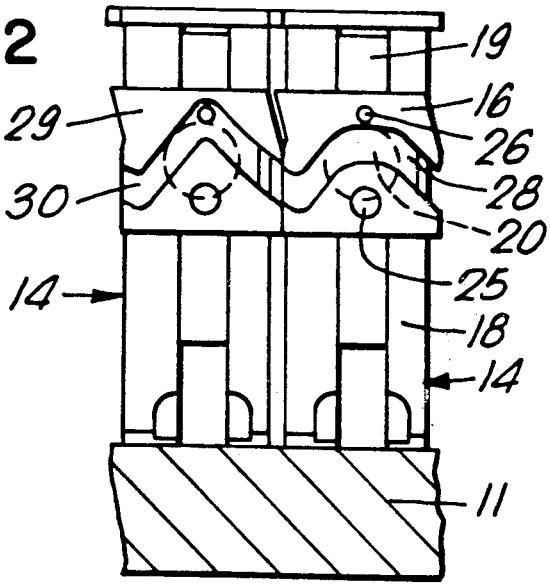
FIG. 2 is a front view of a cam arrangement according to the invention for two adjacent knitting systems of the circular knitting machine shown in FIG. 1, FIG. 3A-E show a front view of a second embodiment of a cam arrangement according to the invention for two adjacent knitting systems each having four cam tracks.

FIG. 2 is a front view of the cam arrangement shown in FIG. 1, with the pins or pegs 25, 26 and the adjusting pin 20 being shown in broken lines. It will be seen therein that the cam portion 16 comprises a solid plate-like body in which the cam track 28, in this case a catch or fancy track, is machined in groove form and is of the width of a knitting system. The adjacent knitting system which is also shown in FIG. 2 has a corresponding cam arrangement which however is provided with a cam portion 29 with a cam track 30.

As can further be seen from FIG. 2, when the carrier 14 is dismantled, the cam portions 16, 29 may simply be pulled out forwardly (corresponding to the direction indicated by the arrow w in FIG. 1) and then replaced by other cam portions with corresponding pins or pegs, without having to actuate fixing screws or the like. Because of the pins or pegs 25 and 26 which are disposed within the outside contour of the cam portions, there is the additional advantage that the cam portions 16 and 29 can be arranged in directly adjacent relationship and there are no gaps between the closed cam tracks 28 and 30.

FIG. 3 shows a two-system cam arrangement each having four cam portions 33, 34 and 35 which are arranged in superposed relationship, wherein the cam portions 33 are each non-knitting portions, the cam portions 34 are each catch or fancy portions and the cam portions 35 are each knitting portions, with corresponding cam tracks 36 to 39 which are extended over the width of the system. The butts 4 of the associated knitting implements 3 are each arranged in a respective one of four planes which are disposed one above the other. The cam portions 34 and 35 are each mounted by pins or pegs 40 and 41 shown in broken lines on a respective movable part 42 which has suitable guide openings in the four superposed regions which serve to accomodate the cam portions 34 and 35, and is mounted displaceably in a fixed part 43 of a carrier 44.

The cam portions 33 could be provided with pins or pegs corresponding to the pins or pegs 40, 41 and mounted on the part 42. As however it is not always desired for reasons concerned with the knitting procedure for the cam portions 33 also to be adjusted when making changes to the stitch length, it is provided according to the invention that the cam portions 33 are provided with pins or pegs 45 and 46 which are disposed at different positions on the cam portions 33 from the pins or pegs 40 and 41, and are associated with further guide openings in the fixed part 43 of the carrier 44. The cam portions 33 are therefore non-displaceably mounted to the carrier 44. In that arrangement the surfaces of the fixed and movable parts 42, 43 are desirably disposed in one plane and sufficiently large intermediate spaces 47 are provided between cam portions which are disposed in superposed relationship, as to permit adjustment of the cam portions 34 and 35 which are mounted to the movable part 42. In addition all carriers 44 are provided in each plane with at least one respective sliding guide on the movable part 42 and the immovable part 43 so that cam portions for different functions can be fitted stationarily or movably to the carrier 44, depending on specific requirements.

FIGS. 4 to 7 show a two-system cam arrangement in which, unlike FIGS. 1 to 3, the cam portions do not have a cam track which extends continuously over the width of the system, insofar as it involves knitting or catch or fancy portions with extension and pull-down tracks.

Each cam arrangement as shown in FIGS. 4 to 7 includes a stationarily disposed carrier 51 with two sections arranged in superposed relationship, for receiving respective cam portions. As both sections of the carrier are of substantially identical configuration, only one of those sections will be described in greater detail hereinafter. Each section includes a sliding guide which is formed from two respective cylindrical guide openings 52 and 53 of different diameters. An inclinedly arranged guide groove 54 is machined into the flat front side of the section, while the end of an adjusting pin 55 which is inserted from the rear side extends into the bottom of the guide groove 54. At its front end face the adjusting pin 55 has a spiral groove 56 as is indicated in the right-hand part of FIG. 4 in relation to the lower section of the carrier and in the left-hand part of FIG. 4 in relation to the upper section of the carrier. The outer end of the spiral groove 56 can be aligned, by rotation of the adjusting pin 55, with the end of a further straight groove 57 which is provided at the bottom of the guide groove 54 and which, like the guide groove 54, extends to the lateral end of the section of the carrier.

Figure 4:
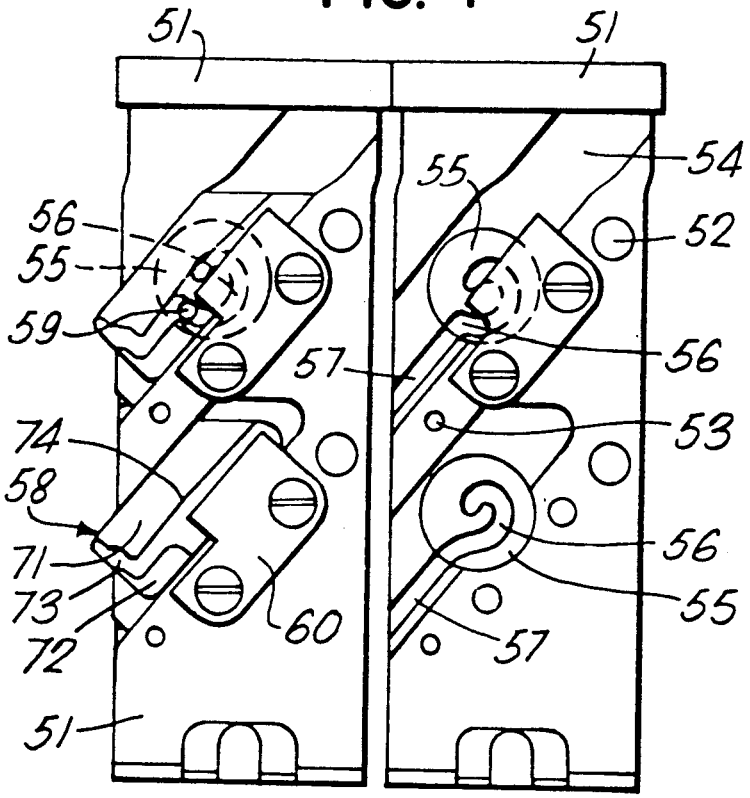
FIGS. 4 and 5 are each a front view of a third embodiment of a cam arrangement according to the invention for two adjacent knitting systems each having two cam tracks with dismantled and assembled cam portions.

A cam portion 58 which is shown at bottom left in FIG. 4 by a thick line and which at its underside has a pin 59 guided in the slot 57 (top left in FIG. 4) can be inserted into the guide groove 54, from the above-mentioned side. By displacement of the cam portion 58, the pin 59 is pused forward into the spiral groove 56 whereupon the adjusting pin 55 is turned and the cam portion 58 is thereby fixed at a preselected level to the carrier 51. In addition the cam portion 58 is prevented from falling out by a holding element 60 which is screwed into the carrier 51 from the front and which engages over a flat part of the cam portion 58. If the adjusting pin 55 is turned back again, with the carrier 51 in a disassembled condition, whereby the free end of the spiral groove 56 is aligned with the groove 57, the cam portion 58 can be pulled out if required towards the side and replaced by another cam portion of suitable configuration, without the holding element 60 having to be released. Alternatively the groove 54 may also be in the form of a T-groove, in which case the holding element 60 can be omitted.

Figure 5:
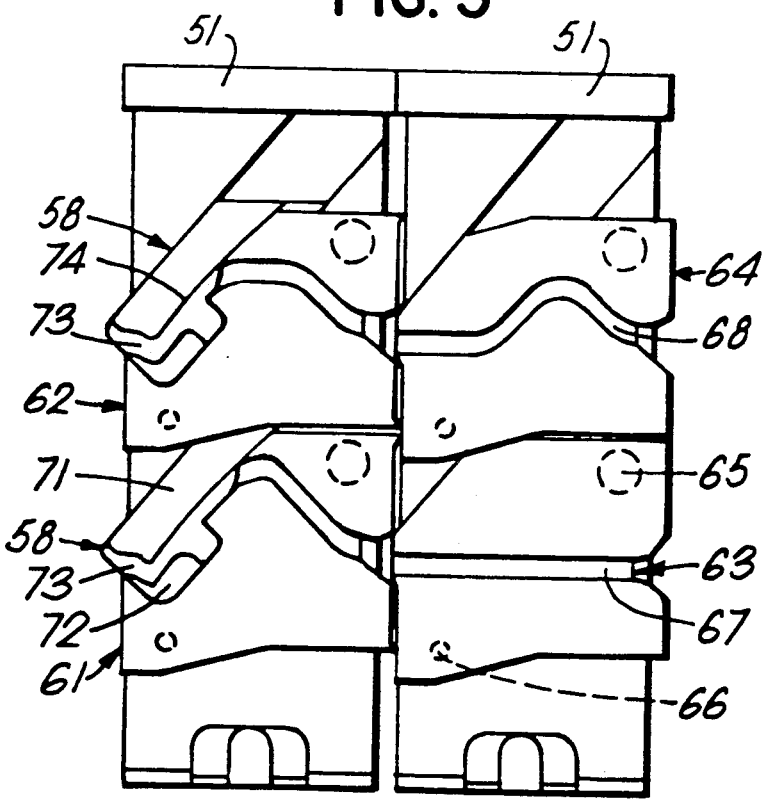
Figure 6A:
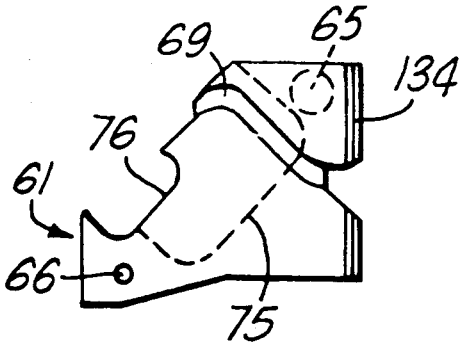
FIGS. 6A-D and 7A-D are a front view and a side view of a set of replaceable cam portions for the cam arrangement shown in FIGS. 4 and 5, FIGS. 8A, 8B, 9A, 9B, 10A, 10B, 11A, 11B, 12A, 12B, 13A, 13B, 14A, 14B, 15A, 15B, 16A and 16B show a view in vertical section and a front view of different embodiments of sliding guides for the cam arrangements according to the invention.
Figure 7A:
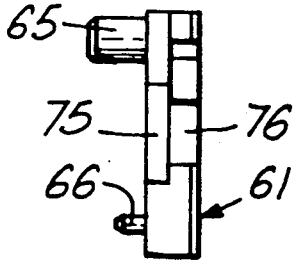
Figure 6B:
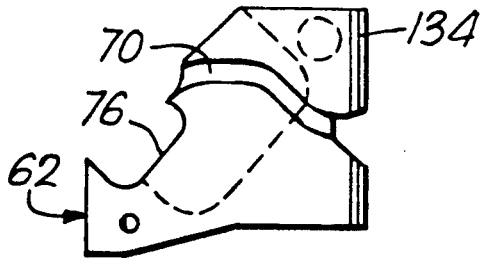
Figure 7B:
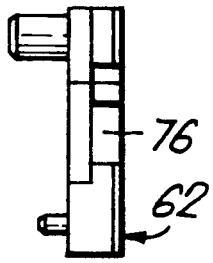
Figure 6C:
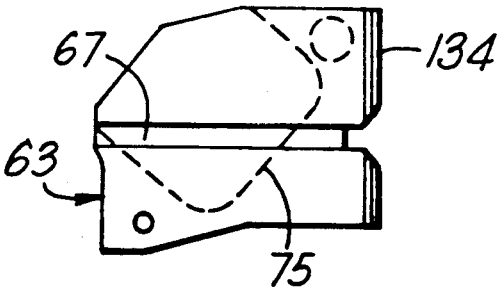
Figure 7C:
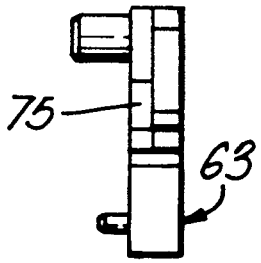
Figure 6D:
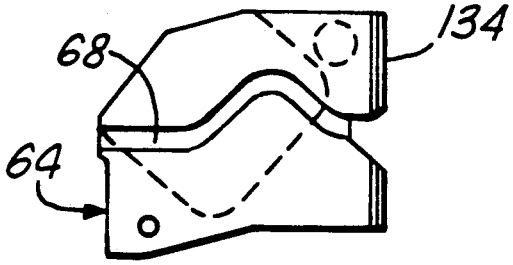
Figure 7D:
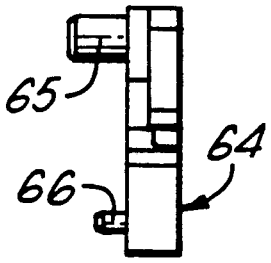

Associated with the carrier 51 is an array of cam portions 61 to 64 (FIGS. 6 and 7) which are provided on their rear side with a respective pair of pins or pegs 65, 66 which fit into the guide openings 52, 53. The pins or pegs are arranged at the same positions on all cam portions and are of such dimensions that they can be fitted with a sliding fit into the guide openings 52, 53. The cam portions 61 to 64 perform different functions and for example are in the form of knitting, catch or fancy, non-knitting or support portions and, as shown in FIG. 5, can be distributed to the different sections of the carriers 51 in dependence on the pattern which is to be knitted.

Unlike the arrangement shown in FIGS. 1 to 3, only the non-knitting and support portions 63 and 64 have closed cam tracks 67 and 68 which extend over the width of the system. In contrast the knitting and catch or fancy portions 61, 62 are provided with tracks which are extended only over somewhat more than half the width of the system and which essentially only represent extension tracks 69 and 70 respectively. The tracks 69 and 70 end where there begin pull-down tracks 73 which are formed by raised projecting sections 71 and 72 of the cam portions 58 and which can be adjusted in respect of height in dependence on the desired stitch length by means of the adjusting pins 55. In that connection the inclined positioning of the guide grooves 54 is so selected that displacement of the cam portions 58 is parallel to the pull-down edge 74 thereof.

In addition all cam portions 61 to 64 are provided at their rear side with a recess 75 in which the holding element 60 comes to lie. The recess 75 can be omitted if the groove 54 is in the form of a T-groove. Furthermore, on their sides towards the cam portions 58, the cam portions 61 and 62 are each additionally provided with a respective recess 76 in which the section 71 of the cam portions 58 is accomodated and which at the same time prevents the cam portions 58 from falling out towards the side. The cam portions 63 and 64 do not have the recess 76 because when they are used the cam portions 58 are not present.

The cam arrangement shown in FIGS. 4 to 7 therefore involves the particular advantage that, in the dismantled condition of the carrier 51, firstly the cam portions 61 to 64 and then also the cam portions 58 can be drawn off and then fitted again in the reverse sequence, without any need to release or screw in a fixing screw or the like.

Although the sliding guides described with reference to FIGS. 1 to 7 are considered to be the best at the present time, further and also preferred embodiments of the sliding guide are shown in FIGS. 8 to 16. In those drawings, reference numeral 81 identifies a carrier and reference numeral 82 identifies a cam portion in each case. The cam tracks of the cam portions are not shown in the sectional views in the left-hand part of each of FIGS. 8 to 16, in order to simplify the drawing.

Figure 8A:
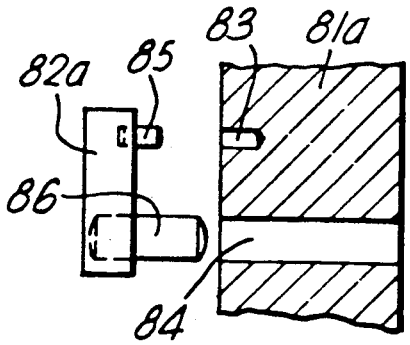
Figure 8B:
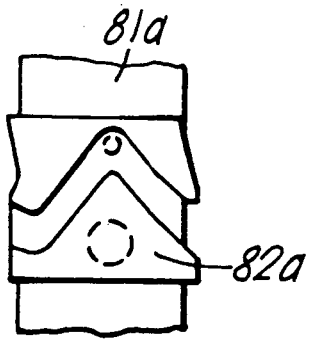

As shown in FIG. 8, the sliding guide in a carrier 81*a* for a cam portion 82*a* comprises two cylindrical guide openings 83 and 84 of different diameters, into which are inserted cylindrical pins or pegs 85 and 86 on the rear side of the cam portion. The guide opening 83 is in the form of a blind bore whereas the guide opening 84 is in the form of a through bore.

Figure 9A:
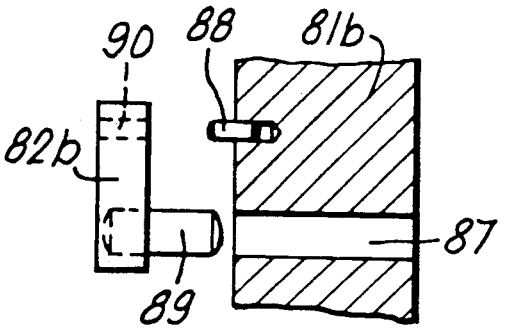
Figure 9B:
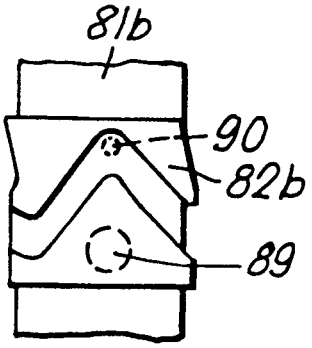

FIG. 9 shows a carrier 81*b* in which the sliding guide comprises a guide opening 87 and a guide pin 88 secured in a bore in the carrier 81*b*. Accordingly a cam portion 82*b* is provided at its rear side with a pin 89 which fits into the guide opening 87 and an opening 90 receiving the guide pin 88.

Figure 10A:
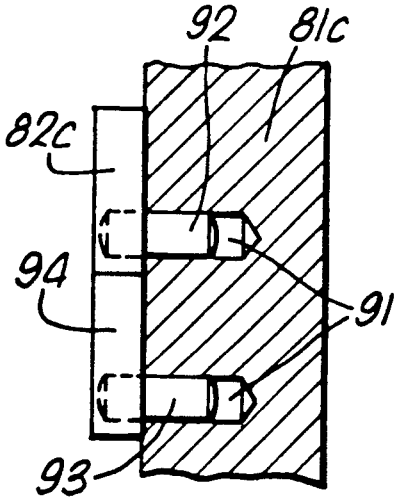
Figure 10B:
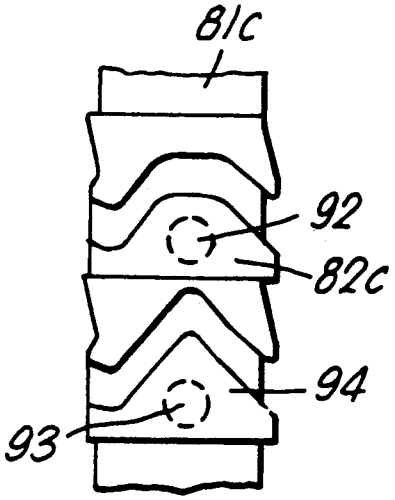

FIG. 10 shows a carrier 81*c* having two cylindrical guide openings 91 of which one receives a pin 92 on a cam portion 82*c* while the other receives a pin 93 on a second cam portion 94. In this case positioning in the directions which are normal to the sliding direction is effected by the lower edge of the cam portion 82*c* and the upper edge of the cam portion 94 bearing against each other, thereby non-rotatably fixing both cam portions.

Figure 11A:
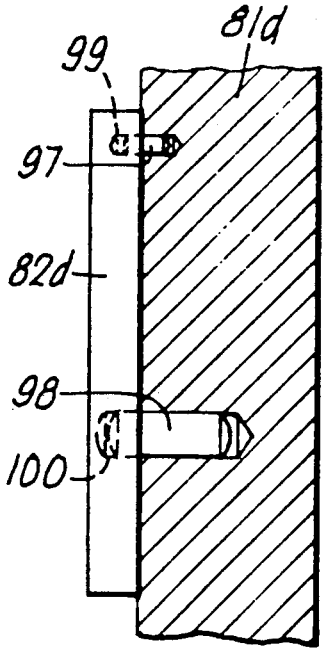
Figure 11B:
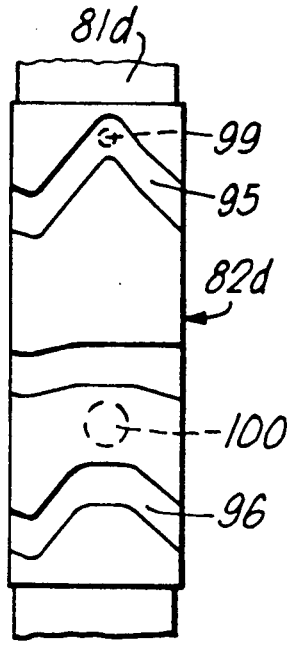

FIG. 11 shows a cam portion 82*d* in which two needle tracks 95 and 96 are provided in superposed relationship. The sliding guide in this construction comprises two cylindrical guide pins 97 and 98 which are fixed to a carrier 81*d* and which extend into corresponding openings 99, 100 in a cam portion 82*d*.

Figure 12A:
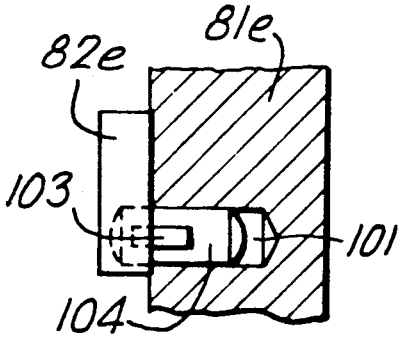
Figure 12B:
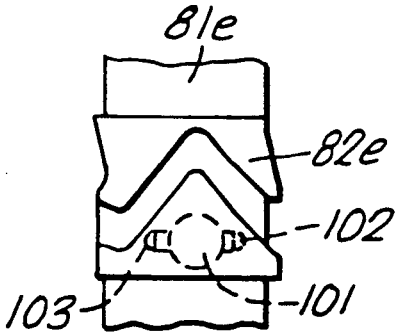

In the embodiment shown in FIG. 12 a carrier 81*e* has at least one guide opening 101 of non-circular cross-section. Provided in the side wall delimiting same are radially outwardly extended enlargement portions 102 in which correspondingly radially outwardly projecting ribs 103 come to lie, the ribs being provided on a pin 104 disposed at the rear side of a cam portion 82*e*. The guide portion 101 is such that the ribs 103 are guided with a sliding fit in the enlargement portions 102 so that the combination consisting of a single guide opening 101 and a single pin 104 already simultaneously provides for positioning of the cam portion 82*e* perpendicularly to the sliding direction. Alternatively the ribs 103 could also be formed by a transverse peg portion in the pin 104 or could be replaced by a single fitting tongue or tenon which engages into a transverse groove in the carrier 81*e*.

Figure 13A:
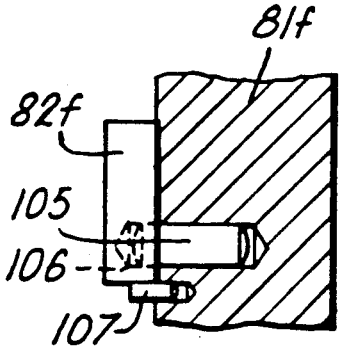
Figure 13B:
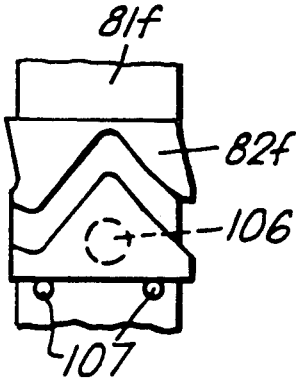

As shown in FIG. 13 the sliding guide may be provided by means of a single cylindrical guide pin 105 in a carrier 81*f*, which is fitted into a single cylindrical opening 106 in a cam portion 82*f*. In this case of course at least one additional positioning element 107 is required, which is preferably disposed on the carrier 81*f*, which projects forwardly in a raised configuration and which bears against the outside contour of the cam portion 82*f*, preferably at the top side or the underside thereof, in such a way that after fitment the cam portion is held non-rotatably. The positioning element 107 is desirably of a length which approximately corresponds to the length of the sliding guide so that it can be viewed as part of the sliding guide. It will be appreciated that in that arrangement, in contrast to the embodiments shown in FIGS. 1 to 12, the holding and positioning elements are not disposed entirely within the outside contour of the cam portions.

Figure 14A:
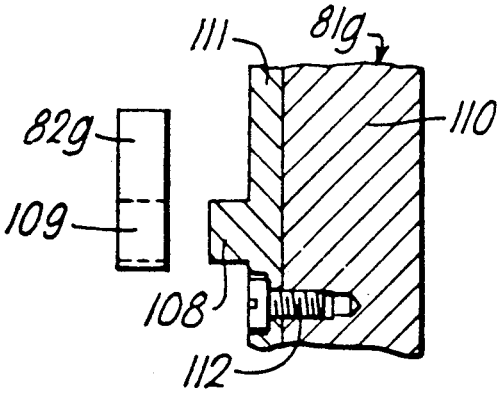
Figure 14B:
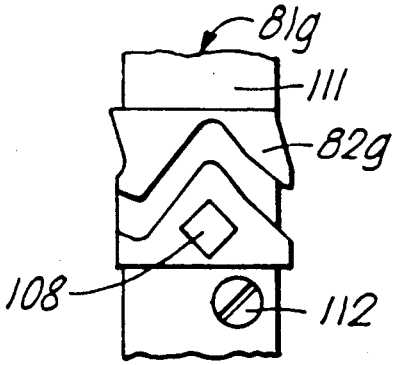

As shown in FIG. 14, the sliding guide on a carrier 81*g*, similarly to FIG. 12, comprises at least one guide pin 108 of a cross-section which departs from a circular configuration, being square in this construction. In this case a cam portion 82*g* is provided with an opening 109 of corresponding cross-section and is non-rotatably guided therewith on the guide pin 108. In that arrangement, and this may also be the case with the other embodiments, the carrier 81*g* comprises a segment 110 which can be screwed to the cam plate, and a receiving plate 111 which is mounted on the front side of the segment and on which the guide pin 108 (or corresponding guide openings) is formed by stamping or pressing and which is secured to the segment 110 by means of a fixing screw 112. Alternatively it would be possible for the cam portion 82*g* to be fixedly connected to the plate 111 and for the latter to be mounted to the segment 110 by means of one of the sliding guides described herein, in which case the plate 111 would be a part of the cam portion 82*g* and not the carrier 81*g*. In that respect it is also possible for a plurality of cam portions to be fixed to the receiving plate 111 and for the entire unit consisting of the receiving plate and the cam portions to be replaced upon a change in pattern. Corresponding receiving plates in the form of narrow bars could serve to mount the cam portions to a movable part of the carrier, for example the part 19 shown in FIG. 1. At any event, in such a construction, the cam portions are also loosely displaceably mounted to the carrier without fixing means and are therefore limitedly reciprocatable during operation of the knitting machine.

Figure 15A:
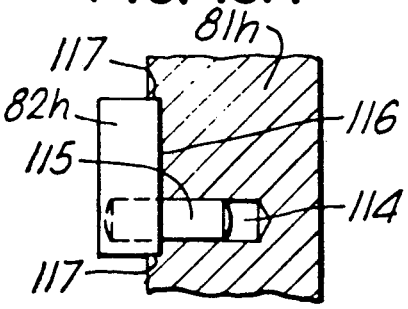
Figure 15B:
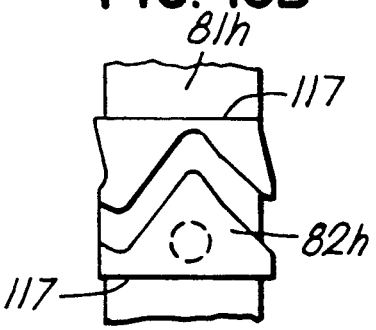

In the embodiment shown in FIG. 15, the sliding guide is formed on a carrier 81*h*, as in FIGS. 10 and 13, only by a single guide opening 114 into which is inserted a pin 115 provided on a cam portion 82*h*. In this arrangement, an additional positioning element is formed by a recess 116 which is provided in the carrier 81*h* and which receives the cam portion 82*h* and the upper and lower walls 117 of which bear against the outside contour of the cam portion 82*h* and fix it non-rotatably to the carrier 81*h*. In that arrangement the recess and the cam portion 82*h* preferably extend over the entire width of the system so that in this case also adjacent cam portions can be arranged directly beside each other and in adjoining relationship with each other, as is desirable in relation to cam portions with closed cam tracks. Alternatively, instead of the recess 116, it would be possible to provide only one of the two wall portions 117 which then forms on the otherwise flat front side of the carrier 81*h* a step against which the upper or lower edge of the cam portion 82*h* comes to bear.

Figure 16A:
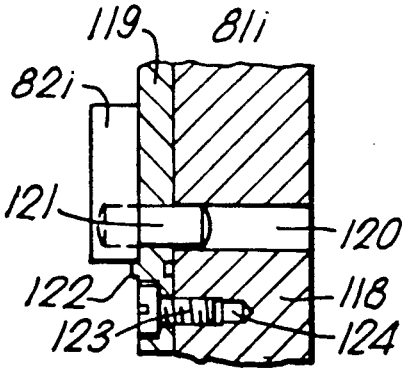
Figure 16B:
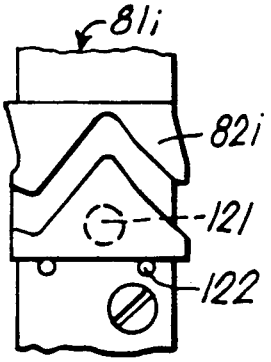

Finally FIG. 16 shows a carrier 81*i* comprising a segment 118 and a stamped or pressed receiving plate 119 which is fixed on the front side thereof. In this embodiment the sliding guide for a cam portion 82*i* is formed by a guide opening 120 which passes through the segment 118 and the receiving plate 119 and which accommodates a pin 121 on a cam portion 82*i*. Pins 122 which project forwardly in raised relationship and which are provided on the receiving plate 119 by stamping or the like serve as additional positioning elements 122. Moreover, in this embodiment also, as described above with reference to FIG. 14, the cam portion 82*i* may be fixed to the receiving plate 119 and the latter may be loosely displaceably held on the carrier 81*i* by means of a sliding guide indicated by pins 123 and guide openings 124. In this case the pin 121 and the guide opening 120 could be omitted.

In the embodiments shown in FIGS. 8, 9, 11, 12 and 14 the sliding guide acts at the same time to provide for positioning of the respective cam portion in all directions which are normal to the sliding movement. In contrast, in the embodiments shown in FIGS. 10, 13, 15 and 16, there are additional positioning elements in the form of pins or pegs, wall portions or the like, which are preferably involved in formation of the sliding guides and which are sufficiently long in the direction of the bed for the knitting implements to prevent the cam portions from sliding off the positioning elements, when fitting the carriers. In addition all guide openings or guide pins or pegs shown in FIGS. 8 to 16 may be of different diameters, lengths and/or shapes so that they clearly establish the position of the cam portions on the carriers and all guide openings and the corresponding openings in the cam portions may each be in the form of through openings or blind bores. Finally a particular advantage of the embodiments shown in FIGS. 1 to 9 and FIGS. 12 to 16 is that all cam portions can be mounted individually and independently of each other so that cumulative errors cannot occur.

Figure 17:
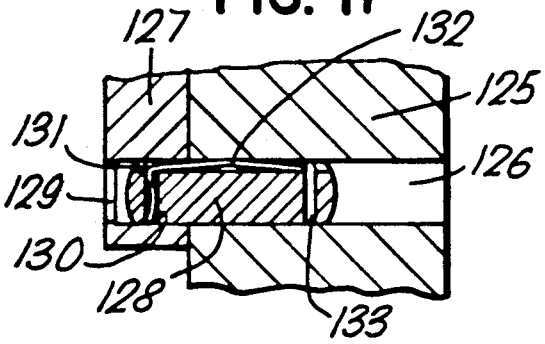
FIG. 17 is a diagrammatic view in section through a further embodiment of a sliding guide for a cam arrangement according to the invention.
Figure 18:
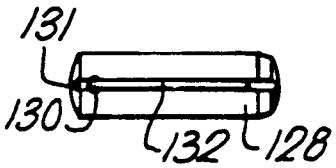
FIG. 18 is a plan view of a detail from FIG. 17.

The embodiment shown in FIGS. 17 and 18 diagrammatically illustrates a carrier 125 with a guide opening 126 and a cam portion 127 with a pin or peg 128 which is intended to be inserted into the guide opening 126 and which is fitted into a bore 129 in the cam portion 127 and secured to the latter. At its end which is mounted in the cam portion 127 the pin or peg 128 has a transverse hole 130 and a longitudinal groove 131 which extends from that end to the other end and which is machined in the peripheral surface of the pin or peg. Fitted into the transverse hole 130 is the one, bent-over end of a clamping spring 132 which is disposed in the longitudinal groove 131 and which serves to jam the peg or pin 128 in the guide opening 126, thereby to prevent the cam portion 127 from falling off when the carrier 125 is being handled. That effect is similar to that afforded by banana-type pins or plugs. In addition the longitudinal groove 131 affords the advantage that it allows compressed air in the guide opening 126 to escape, thereby making it easier to insert the pin or peg 128, particularly when the guide opening 126 is a blind hole. Alternatively the pin or peg 128 may also be a guide pin or peg which is provided on the carrier 125. In that case the guide pin or peg would have a transverse hole 133 such as is indicated by a broken line in the right-hand part of FIG. 17, in order to be jammed in the bore 129 in the cam portion 127 when the cam portion is fitted into position.

The invention is not restricted to the embodiments described which may be modified in many ways. Instead of being needles 3 and sinkers 7, the knitting implements may also be pressers, plush hooks or the like, and the described cam portion holding means, without fixing screws, besides being used in the cylinder cam 9, may also be employed in the sinker cam 10 (FIG. 1) or a rib cam formed with cam portions for rib needles. It is also possible to provide cam portions other than those illustrated, in particular cam portions which do not have continuous cam tracks in the form of grooves, but which may form a complete needle track for a knitting system only in combination with additional cam portions. When using guide pins or guide openings of non-circular cross-section the associated openings and pins may also be of cross-sections which differ from each other, for example a hexagonal guide pin may be paired with a quadrangular opening. In addition the cam portions are preferably provided at the side at which the butts of the knitting implements pass into the respective cam track with an inclined entry portion as indicated at 134 in FIG. 6, the depth of which at least approximately corresponds to the magnitude of the cam play. In that way knitting implements which project too far from the bed are pushed into the bed or the cam portions themselves are displaced in the direction of the carrier by the lands or knitting implements passing on to same, so as reliably to avoid damage to the cam portions, knitting implements and lands.

The pins or pegs (for example 65, 66) or guide pins or pegs (for example 97, 98) preferably comprise steel pins or pegs, wherein the smaller pins or pegs may be of a diameter of at least 2.5 mm and the larger pins or pegs may be of a diameter of at least 4 mm in order to be able to carry the forces applied to the cam portions. In addition at least the walls of the openings (for example 52, 53) or guide openings (for example 99, 100) as well as the pins or pegs and guide pins or pegs should consist of high-strength steel or should be hardened so that they do not wear away. Finally at those locations on the beds carrying the knitting implements, where there are no lands or knitting implements inserted, it would be possible to envisage the provision of suitable safety members in order to restrict the possible movements of the cam portions in the direction of the bed.

It will be appreciated moreover that the embodiments illustrated by way of example in the drawings can be used both individually and also in all combinations which are not expressly described, and can be significant from the point of view of the invention.

We claim:

1. A knitting machine, comprising at least one bed having a plurality of lands forming tricks for supporting knitting implements; and a cam arrangement for controlling the knitting implements and including a cam plate, at least one carrier mounted to said cam plate at a fixed spacing from said bed, at least one cam portion and mounting means for non-rotatably mounting said cam portion to said carrier, said mounting means being disposed on said carrier and consisting of sliding guide means for loosely and displaceably mounting said cam portion to said carrier with a sliding fit and without the use of fixing means, said sliding guide means being formed and extending toward said bed in such a way that in a dismantled condition of said carrier a fitting or a removal of said cam portion from a front of said carrier is permitted and that in a mounted condition of the carrier sliding movements of said cam portion toward said bed are possible, which sliding movements are restricted on one side by said carrier and on the other side by said lands of said bed or by the knitting implements, whereas in all directions normal to said sliding movements said cam portion is fixedly positioned by said sliding guide means.

2. A knitting machine as defined in claim 1, wherein said cam arrangement includes a set of cam portions of different functions, said first mentioned cam portion being selected from said set of cam portions of different functions.

3. A knitting machine as defined in claim 2, wherein all said cam portions of said set of said cam portions are formed so that they can be mounted to said carrier with a sliding fit and with sliding guide means of the same kind.

4. A knitting machine as defined in claim 1, wherein said cam arrangement has a set of cam portions and a plurality of carriers for at least one of respective cam portions, said cam portions of said set of cam portions being mounted to said carriers with identical sliding guide means.

5. A knitting machine as defined in claim 1, wherein said carrier has an immovable part, said sliding guide means being provided on said immovable part.

6. A knitting machine as defined in claim 1, wherein said carrier has a movable part, said sliding guide means being provided on said movable part of said carrier.

7. A knitting machine as defined in claim 1, wherein said cam arrangement has a set of cam portions of different functions, said carrier having at least two sliding guide means for said cam portions of said set of cam portions with different functions.

8. A knitting machine as defined in claim 7, wherein said carrier has an immovable part and a movable part, one of said sliding guide means being provided on said immovable part of said carrier, while another sliding guide means is provided on said movable part of said carrier.

9. A knitting machine as defined in claim 1, wherein said cam portion includes a raising track, said carrier having a stationary part provided with said sliding guide, said cam arrangement including an additional cam portion provided with a draw-down track adjoining said raising track and arranged displaceably on said carrier.

10. A knitting machine as defined in claim 9, wherein said carrier has a fixed part; and further comprising a holding element secured to said fixed part of said carrier, said additional cam portion being guided displaceably between said carrier and said holding element.

11. A knitting machine as define in claim 1, wherein said sliding guide means has at least one guide pin of a cross-section which differs from a circular configuration, said cam portion having an opening which is guided on said guide pin with a sliding fit and non-rotatably.

12. A knitting machine as defined in claim 11, wherein said guide pin has a longitudinal groove.

13. A knitting machine as defined in claim 11, wherein said guide pin has a transverse hole and a longitudinal groove; and further comprising a clamping spring arranged in said longitudinal groove.

14. A knitting machine as defined in claim 1, wherein said sliding guide means has at least one guide opening of a cross-section which differs from a circular configuration, said cam portion having a pin which is guided in said guide opening with a sliding fit and non-rotatably.

15. A knitting machine as defined in claim 14, wherein said pin has a longitudinal groove.

16. A knitting machine as defined in claim 14, wherein said pin has a transverse hole and a longitudinal groove; and further comprising a clamping spring arranged in said longitudinal groove.

17. A knitting machine as defined in claim 1, wherein said sliding guide means has at least two cylindrical guide pins, said cam portion having at least two openings guided on respective ones of said guide pins with a sliding fit.

18. A knitting machine as defined in claim 17, wherein said guide pins have different diameters.

19. A knitting machine as defined in claim 1, wherein said sliding guide means has at least two cylindrical guide openings, said cam portion having at least two pins which are guided in respective ones of said guide openings with a sliding fit.

20. A knitting machine as defined in claim 19, wherein said guide openings have different diameters.

21. A knitting machine as defined in claim 1, wherein said sliding guide means has at least one cylindrical guide pin and a cylindrical guide opening, said cam portion having at least one opening guided on said guide pin with a sliding fit and a pin guided in said guide opening with a sliding fit.

22. A knitting machine as defined in claim 21, wherein said guide pin and said guide opening have different diameters.

23. A knitting machine as defined in claim 1, wherein said cam portion is provided with at least one inclined entry portion.

24. A knitting machine as defined in claim 1, wherein said carrier has a receiving plate.

25. A knitting machine as defined in claim 1, wherein said cam portion has a receiving plate.

26. A knitting machine, comprising at least one bed having a plurality of lands forming tricks for supporting knitting implements; and a cam arrangement for controlling the knitting implements and including a cam plate, at least one carrier mounted to said cam plate at a fixed spacing from said bed, at least one cam portion, and mounting means for mounting said cam portion to said carrier, said mounting means being disposed on said carrier and consisting of sliding guide means and at least one additional positioning element cooperating with said cam portion for loosely and displaceably, but non-rotatably mounting said cam portion to said carrier with a sliding fit and without the use of fixing means, said sliding guide means being formed and extending toward said bed in such a way that in a dismantled condition of said carrier a fitting or a removal of said cam portion from a front of said carrier is permitted and that in a mounted condition of the carrier sliding movements of said bed are possible, which sliding movements are restricted on one side by said carrier and on the other side by said lands of said bed or by the knitting implements, whereas in all directions normal to said sliding movements said cam portion is fixedly positioned by said sliding guide means and said positioning means.

27. A knitting machine as defined in claim 26, wherein said sliding guide means is formed as a cylindrical guide pin, said cam portion having an opening guided on said guide pin.

28. A knitting machine as defined in claim 26, wherein said sliding guide means is formed as a cylindrical guide opening, said cam portion having a pin projecting into said guide opening.

29. A knitting machine as defined in claim 26, wherein said additional positioning element is formed as a raised projecting pin portion.

30. A knitting machine as defined in claim 26, wherein said additional positioning element has a raised projecting wall portion.

* * * * *